US007578492B2

(12) United States Patent
Darre'

(10) Patent No.: US 7,578,492 B2
(45) Date of Patent: Aug. 25, 2009

(54) ADJUSTABLE HANGER

(76) Inventor: Laura Darre', 1814 Greystone Rd., NW., Atlanta, GA (US) 30318

( * ) Notice: Subject to any disclaimer, the term of this patent is extended or adjusted under 35 U.S.C. 154(b) by 0 days.

(21) Appl. No.: 10/975,706

(22) Filed: Oct. 28, 2004

(65) Prior Publication Data

US 2006/0060748 A1 Mar. 23, 2006

Related U.S. Application Data

(60) Provisional application No. 60/572,831, filed on May 20, 2004.

(51) Int. Cl.
*A47B 96/06* (2006.01)

(52) U.S. Cl. ..... 248/477; 248/496; 248/217.4

(58) Field of Classification Search ..... 248/475.1, 248/214, 215, 297.21, 295.11, 244, 257, 248/265, 217.4, 546, 547, 477, 496, 297.31; D8/367; 40/757, 713; 33/613
See application file for complete search history.

(56) References Cited

U.S. PATENT DOCUMENTS 427,462 A * 5/1890 Crider ..... 248/244
1,107,686 A * 8/1914 Mehrmann ..... 248/495
1,294,916 A * 2/1919 Knight ..... 211/103
2,478,256 A 8/1949 Eysmann
2,614,471 A * 10/1952 Markowitz ..... 396/422
2,681,194 A * 6/1954 Halvorsen ..... 248/495
2,697,572 A 12/1954 Pfankuch
2,920,853 A * 1/1960 Bufogle ..... 248/214
3,360,229 A 12/1967 Beyer
3,664,626 A * 5/1972 Sneller ..... 248/224.7
5,100,094 A * 3/1992 Handwerger et al. ..... 248/489
D349,447 S 8/1994 Daniller ..... D8/367
6,152,418 A 11/2000 Panicci ..... 248/496
6,666,425 B1 12/2003 Ferguson ..... 248/477

* cited by examiner

*Primary Examiner*—Gwendolyn Baxter
(74) *Attorney, Agent, or Firm*—Dennis W. Jones

(57) ABSTRACT

An adjustable hanger for hanging pictures, tools, or the like has an elongated, slotted bracket member having a wall mounting portion at one end thereof. A hanger hook member has a vertical portion with a bolt hole adjacent one end and is adapted to be positioned anywhere along the bracket by means of a bolt member and a resilient washer. The surfaces of the bracket and the vertical portion of the hook member may be roughened or striated to insure better purchase of the resilient washer between those two members when compressed by the action of the bolt member.

14 Claims, 1 Drawing Sheet

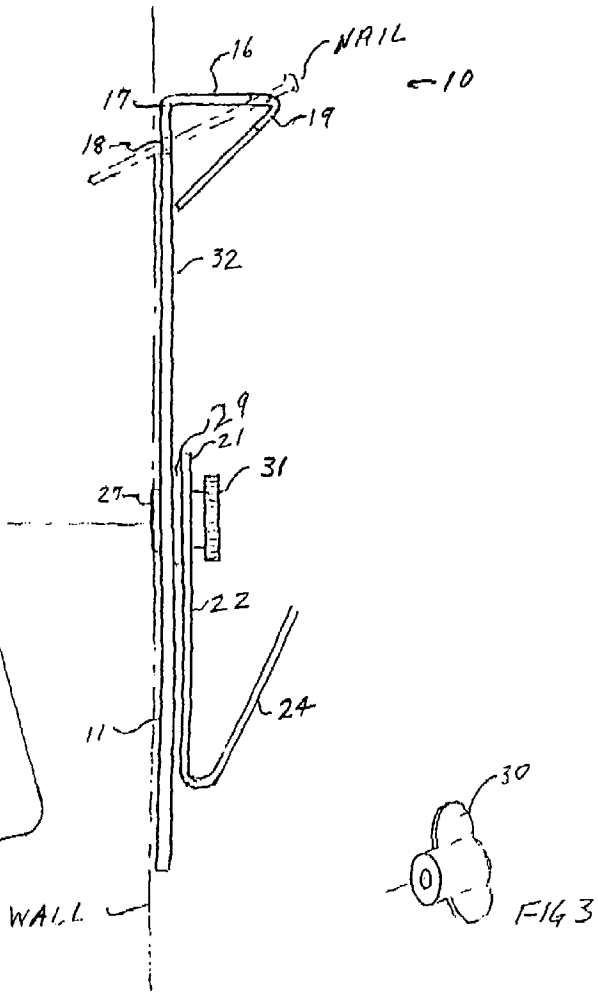
FIG 2
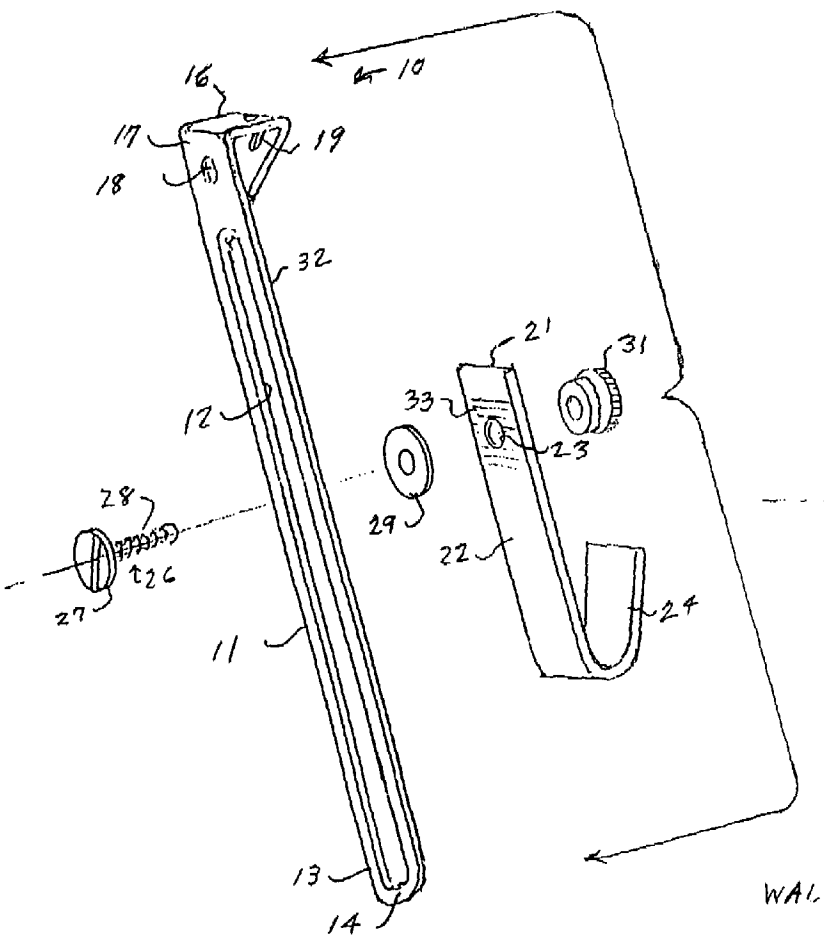
FIG. 1
FIG 3

ADJUSTABLE HANGER

RELATED APPLICATIONS AND CLAIM OF PRIORITY

The present invention is the subject of U.S. Provisional Patent Application Ser. No. 60/572,831, filed May 20, 2004, by the present inventor, and in view of which priority is claimed for the present application.

FIELD OF THE INVENTION

This invention relates to hangers for pictures, tools, utensils, and, more particular, to an adjustable hanger.

BACKGROUND OF THE INVENTION

While the present invention, as will be apparent hereinafter, is applicable to hanging a wide range of articles, the following discussion will be in the context of hanging pictures although it is not intended that the invention be limited thereto. Wall hanging of pictures, such as in the home, is accomplished most often by use of a metal hook having a vertical shank, and a roughly triangular nail holder at the top of the shank which permits a nail to be driven into the wall in an angular or toed orientation. Where a particular pattern of framed pictures, such as in a straight horizontal array, is desired, precise measurements must be made to achieve a linear alignment of the hangers. Some compensation for a failure to achieve precise alignment or position can be had by increasing or decreasing the slack in the usual hanging wire which extends across the rear of the frame. However, it often happens that misalignment is substantial, and cannot thus be remedied. In such case, the hanger itself must be repositioned, necessitating creating a new nail hole, and leaving an unsightly empty hole in the wall.

There are numerous prior art arrangements for achieving a greater degree of adjustment of hanger position. In U.S. Pat. No. 2,478,256 of Eysmann, for example, a flat plate has a plurality of vertically spaced hooks on the rear (wall side) face thereof, and a centrally positioned vertically extending slot through which a picture hook can be supported by the rear facing hooks. The height adjustments of the picture hook are limited to spaced increments, and a recess in the wall is required.

In U.S. Pat. No. 3,360,229 of Beyer, the picture hanger comprises a plurality of vertically spaced hooks, thereby allowing only discrete incremental positioning of the picture.

U.S. Pat. No. 2,697,572 of Pfankuch, et al. discloses an adjustable hanger in which a hook portion slidably mounted to a wall mounted member, and is raised or lowered by means of a vertically extending threaded bolt which extends between the two elements. Such an arrangement permits minute changes in the height of the hook, eliminating the incremental steps of the Beyer and Eysmann arrangements but the amount of change is limited by the length of the bolt. Other incremental step adjustments are shown in U.S. Pat. No. 6,152,418 of Panicci, U.S. Pat. No. 6,666,425 of Ferguson, and Des. U.S. Pat. No. 349,447 of Daniller, all of which are directed to adjusting the height of a picture, for example. In the prior art, as exemplified by the foregoing patents, vertical adjustment is generally achieved in incremental steps, with attendant limitation on achieving the exact picture height desired.

SUMMARY OF THE INVENTION

The present invention is an adjustable wall hanger having a wide range of height adjustments which is not dependent upon the predetermined increments of adjustments which is prevalent in the prior art, but, instead, gives a precise adjustment.

The invention, in a preferred embodiment thereof, comprises an elongated, substantially flat support bracket having first and second ends. Extending between said first and second ends is a longitudinal slot having a transverse closure adjacent each of the first and second ends of the bracket.

The first end of the bracket is shaped or has, for example, a hole to form a mounting member for mounting the bracket to a wall, as by nailing. A hook member having a vertically extending portion and having a hook at one end thereof and a bolt hole in the vertically extending portion is mounted to the bracket by means of a bolt or other suitable mounting means extending through the slot and the hole in the vertically extending member.

The bolt has a threaded shank and, preferably, a flat head, and is inserted through the slot from the rear of the bracket, through a washer, preferably of soft or resilient material, and through the bolt hole in the hook member. A nut is screwed onto the threaded shank and, when screwed down, compresses the washer and thereby firmly affixes the hook member to the bracket. Adjustment of the position of the hook member along the length of the slot is made by loosening of the nut, sliding the hook member to its desired position, and re-tightening the nut.

The nut itself may take any of a number of forms, from a simple knurled member to a wing-nut or even to a hexagonal nut where extreme clamping pressure is needed. Also, the front surface of the bracket may be striated or otherwise roughened to allow the washer to make more positive fixation of position. The surface of the hook member which bears against the washer may also be striated or otherwise roughened.

The features and novel aspects of the present invention will be more clear from the following detailed description, read in conjunction with the accompanying drawings.

BRIEF DESCRIPTION OF THE DRAWINGS

FIG. 1 is an exploded perspective view of the present invention showing all of the elements which comprise the hanger;

FIG. 2 is a side elevation view of the assembled hanger as mounted on a flat surface such as a wall; and FIG. 3 is a perspective view of an alternative component of the invention.

DETAILED DESCRIPTION

As seen in FIGS. 1 and 2, the adjustable hanger 10 of the present invention comprises an elongated support bracket 11 of brass, aluminum, or other suitable material, preferably, but not necessarily, of a metal having sufficient strength to accommodate reasonably heavy loads. Extending along the length of bracket 11 is a longitudinal slot 12, closed at the bottom or distal end 13 by a cross-piece 14. A typical mounting triangle 16 is at the top or proximal end 17, the lower portion of which closes slot 12. A pair of holes 18 and 19, vertically offset from each other as shown are formed in different legs of mounting triangle 16 for allowing a hanger nail to be driven into a wall in a slanted or toed orientation, as shown in FIG. 2, to mount bracket 11 to the wall. While a mounting triangle is shown, other mounting means known in the art, including a simple mounting hole, may be used.

A hook member 21 of suitable material such as brass, aluminum, or other material, preferably metal, having first and second surfaces, has a vertically extending portion 22 which has a bolt hole 23 adjacent its upper end and, at its lower end is formed into a hook portion 24. Hook member 21 is adjustably affixed to bracket 11 by means of a bolt 26 preferably having a flat head 27 and a threaded shank 28. Shank 28 is sized to pass through slot 12, a resilient washer 29, and bolt hole 23, and is held by a suitable nut 31 which is threaded onto the shank 28. Nut 31 may be a knurled nut, as shown, or, for example, a wing-nut 30 shown in FIG. 3 or even a hex nut, either of which gives an extra measure of clamping force to clamp hook member 21 to bracket member 11. Washer 29 is preferably made of soft plastic or rubber which slightly deforms under the pressure of clamped hook member 21 to insure a fixed position thereof. Where greater purchase of washer 29 between hook member 21 and the rear face or surface 32 of bracket member 11, the washer contacting face, the first face, of the vertical portion 22 of hook member 21 may have striations 33 in the region of bolt hole 23. Means other than striations may be used, such as roughing or knurling the contacting face. Also, face 32 of bracket 11 may be striated, knurled, or otherwise roughened to afford greater purchase of the compressed washer 29.

In operation, the position of hook member 21 relative to the proximal end 17 of bracket 11 can be selected by simply loosening nut 31, sliding hook member 21 to the desired position, and tightening nut 31 to clamp hook member 21 in the chosen location. Adjustment and positioning does not depend on grooves or other types of fixed incremental locating members, as in the prior art, thus even minute adjustments may be made as well as large adjustments which are only limited by the length of slot 12.

It is to be understood that the various features of the present invention might be incorporated into other types of hanger members, such as hangers for supporting heavy weights such as various types of tools, and that other modifications are adaptations might occur to workers in the art. All such variations and modifications are intended to be included herein as being within the scope of the present invention as disclosed and claimed herein. Further, in the claims hereinafter, the corresponding structures, materials, acts and equivalents thereof and of all means or step-plus-function elements are intended to include any structure, material, or arts for performing the functions in combination with other elements as specifically claimed.

The invention claimed is:

1. An adjustable picture hanger comprising:

an elongated support bracket having front and rear surfaces and having a first end and a second end and having a longitudinally extending slot therein between said first and second ends, said rear surface being roughened;

wherein the first end of the elongated support bracket is a mounting member having at least one mounting hole capable of receiving a nail for mounting said elongated support bracket to a wall;

a hook member comprising a vertically extending portion having a hook portion at a lower end thereof and a bolt hole in said vertically extending portion, said vertically extending portion having first and second surfaces, said first surface being roughened in a region of the bolt hole, the hook portion extending upward from the lower end and away from the vertically extending portion;

a bolt member having a substantially flat head and a threaded shank extending through said slot, said flat head being adapted to bear against said front surface of said support bracket;

a resilient washer member surrounding said shank against said rear surface of said support bracket, and said first surface of said vertically extending portion of said hook member to grip the roughened surfaces to fix them in place relative to each other and maintain said surfaces to fix them in place relative to each other and maintain said rear surface of said bracket and said first surface in spaced relationship;

and a nut threaded onto said shank and bearing against said second surface of said vertically extending portion of said hook member to fix said first and rear surfaces in fixed position when tightened on said shank.

2. An adjustable hanger as claimed in claim 1 wherein said elongated support bracket has a slot closure portion at said second end.

3. An adjustable hanger as claimed in claim 1 wherein said resilient washer member is made of a soft plastic.

4. An adjustable hanger as claimed in claim 1 wherein said resilient washer member is made of rubber.

5. An adjustable hanger as claimed in claim 1 wherein said nut has a knurled surface.

6. An adjustable hanger as claimed in claim 1 wherein said nut is a wing-nut.

7. An adjustable hanger as claimed in claim 1 wherein said first surface is striated in the region of said bolt hole.

8. An adjustable hanger as claimed in claim 1 wherein said first surface is knurled in the region of said bolt hole.

9. An adjustable hanger as claimed in claim 1 wherein said resilient washer member is adapted to bear against both said roughened portion of the said first surface and the rear surface of said bracket member.

10. An adjustable hanger as claimed in claim 1 wherein the mounting member is a mounting triangle comprising two mounting holes.

11. An adjustable hanger as claimed in claim 1 wherein the mounting member closes the longitudinally extending slot.

12. An adjustable hanger as claimed in claim 1 wherein the rear surface of the elongated support bracket is roughened along the entire length thereof.

13. An adjustable hanger as claimed in claim 1 wherein the rear surface of the elongated support bracket is striated along the entire length thereof.

14. An adjustable hanger as claimed in claim 1 wherein the rear surface of the elongated support bracket is knurled along the entire length thereof.

* * * * *